United States Patent [19]

Newman

[11] 3,985,315

[45] Oct. 12, 1976

[54] PACKAGE OF FLEXIBLE MATERIAL FOR TWISTLESS PAYOUT WITH WIDE FUNNEL GUIDE

[75] Inventor: James W. Newman, Scarsdale, N.Y.

[73] Assignee: Windings, Inc., Goldens Bridge, N.Y.

[22] Filed: Sept. 18, 1972

[21] Appl. No.: 290,007

[52] U.S. Cl. ..... 242/163; 242/171

[51] Int. Cl.[2] ..... B65H 55/02

[58] Field of Search ..... 242/163, 170, 171, 128, 242/129.5, 130, 132, 141, 146

[56] References Cited

UNITED STATES PATENTS

| | | | |
|---|---|---|---|
| 2,634,922 | 4/1953 | Taylor, Jr. | 242/163 |
| 3,677,490 | 7/1972 | Gordon et al. | 242/163 |
| 3,677,491 | 7/1972 | Gerwig | 242/163 |
| 3,689,005 | 9/1972 | Newman | 242/163 |

*Primary Examiner*—Stanley H. Gilreath

[57] ABSTRACT

In a package formed of a plurality of layers each composed of a number of figure 8 winds with the cross-overs progressing around the package and with a radial opening extending from the periphery of the package to the axial opening through which radial opening the inner end of the material is led out, a funnel is provided with a stem positioned in the radial opening and with its mouth substantially at the mid-plane of the package. The funnel has a width in the axial direction of the package at least substantially as great as the axial length of the package. The funnel may be mounted in such a way that it can wobble slightly. The funnel guides the loops falling off of the inside wall of the package so as to prevent birdsnesting and provide for continuous and rapid payout.

7 Claims, 8 Drawing Figures

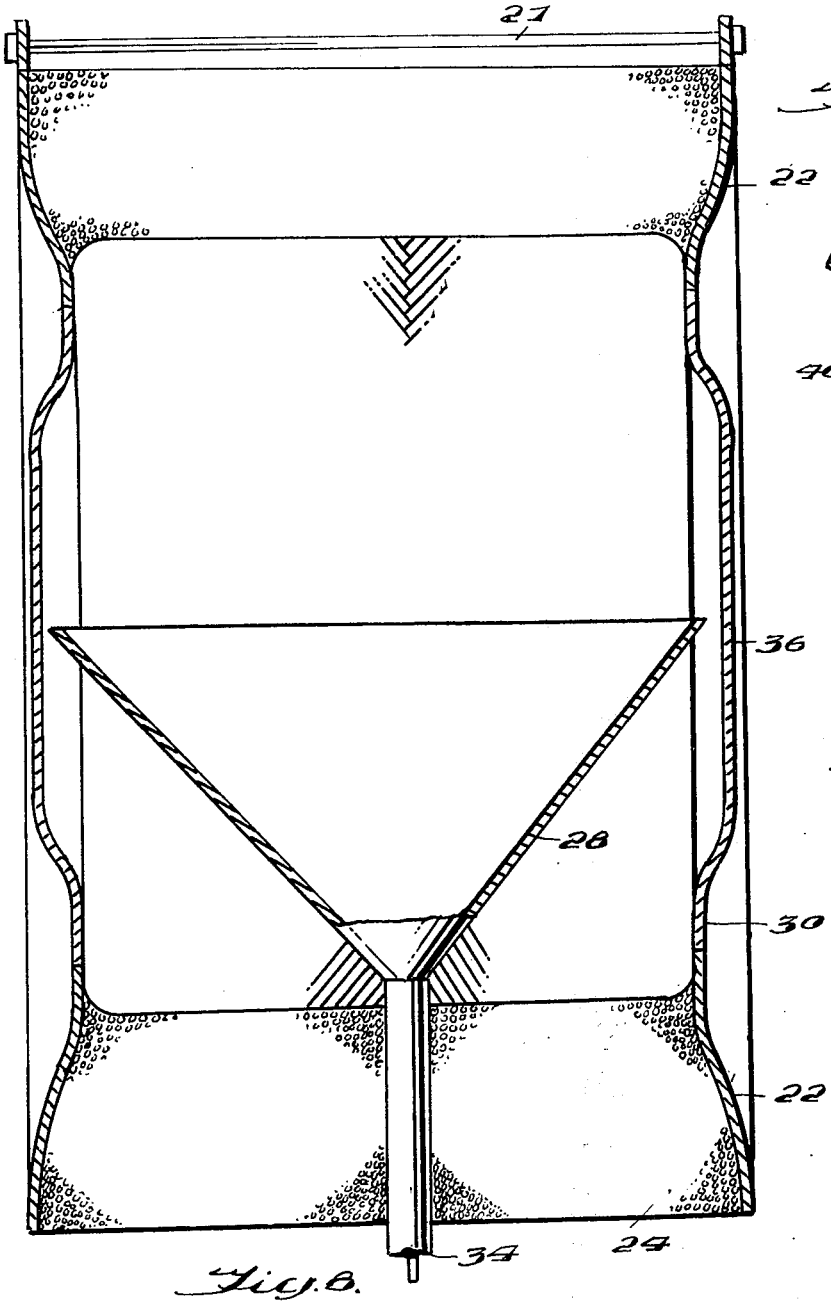
Fig. 5.
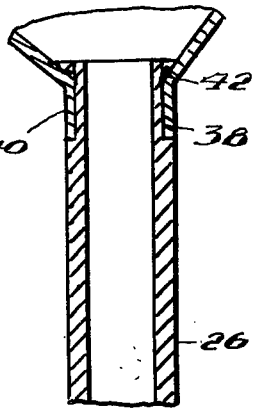
Fig. 6.
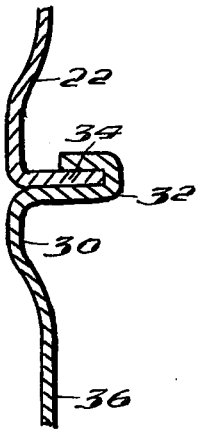
Fig. 7.
Fig. 8.
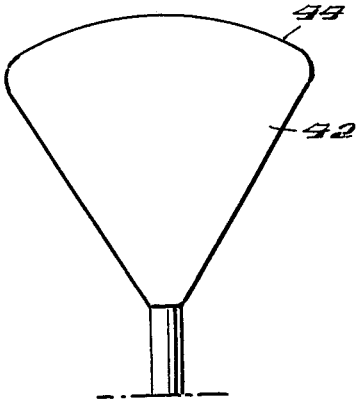

PACKAGE OF FLEXIBLE MATERIAL FOR TWISTLESS PAYOUT WITH WIDE FUNNEL GUIDE

BACKGROUND OF THE INVENTION

1. Field of the Invention

The invention relates to a package of flexible material with payout from the axial opening of the package through a radial opening.

2. The Prior Art

Such packages are known for example from Taylor U.S. Pat. Nos. 2,634,922 and 2,828,092.

SUMMARY OF THE INVENTION

The present invention relates to an improvement on the feedout for such packages, so as to prevent birdsnesting or other tangles which might interfere with the withdraw of the material.

The particular feature of the present invention lies in the use of a funnel connected with a payout tube, the payout tube passing through the radial opening, and the funnel being at least substantially as wide as the axial length of the package.

The funnel preferably has its base or open end located substantially at the center plane of the package and extends across substantially the whole width of the package. In this respect it is in contrast to the cone shown in an earlier Taylor patent, which is of relatively smaller width.

BRIEF DESCRIPTION OF THE DRAWINGS

Referring to the drawings,

FIG. 5 shows in cross-section still another form of the invention.

FIG. 6 shows in cross-section the mounting of the funnel on the tube.

FIG. 7 is a detailed cross-section of the joint between the end forms and the end plates of FIG. 5.

FIG. 8 shows in side view another type of funnel.

DESCRIPTION OF THE PREFERRED EMBODIMENTS

Figure 1:
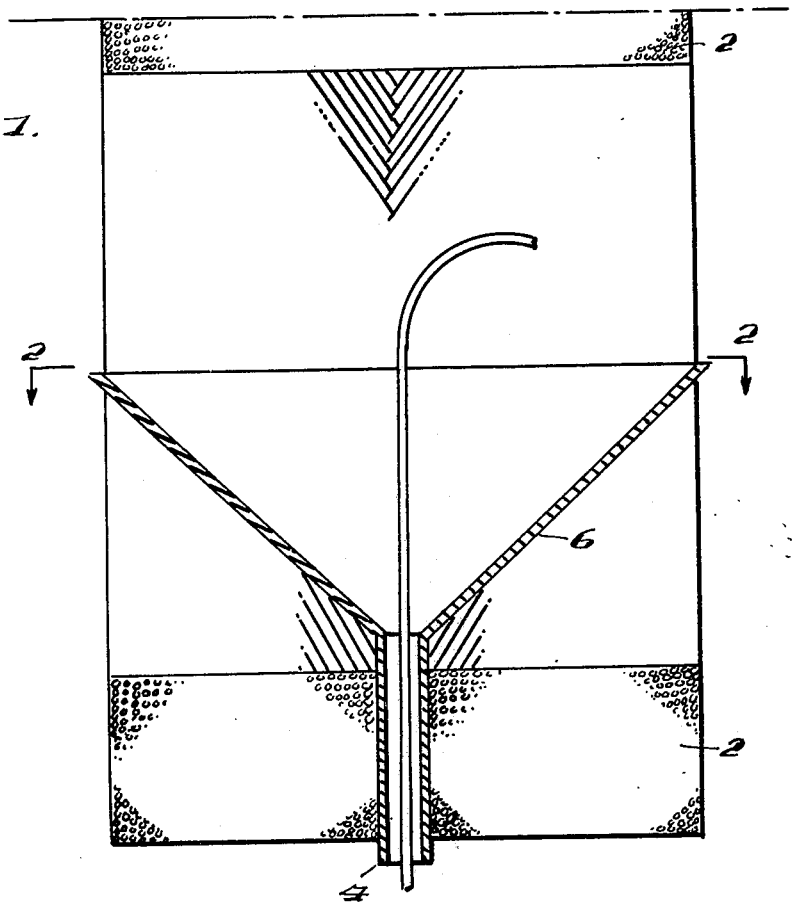
FIG. 1 shows in cross-section a package embodying the invention.

Referring now to FIG. 1, a universally wound package with a radial opening extending from the periphery of the package to the axial opening is indicated at 2. Through the radial opening in one wall is extended a tube 4. This tube at its inner end supports a funnel 6, which is at least substantially as great in width as the package 2 and may be slightly greater in width.

As the material is withdrawn from the package, it forms loops alternately on opposite sides, which are guided by the funnel 6 as they are withdrawn and thus spread wide during their withdrawal. It has been found that this construction is quite effective in preventing birdsnesting.

Figure 2:
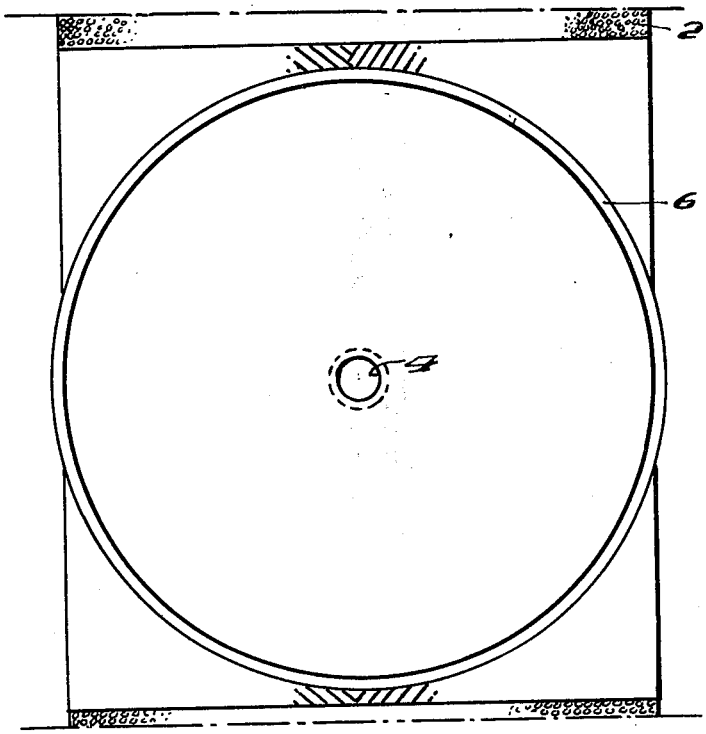
FIG. 2 a cross-section substantially on the line 2—2 of FIG. 1.

The package shown in FIGS. 1 and 2 is one in which the axial dimension of the package is slightly less than the internal diameter. In this case a round cone is used, which is spaced from the wall of the package at the beginning of the withdrawal by not more than about one-fourth inch.

Figure 3:
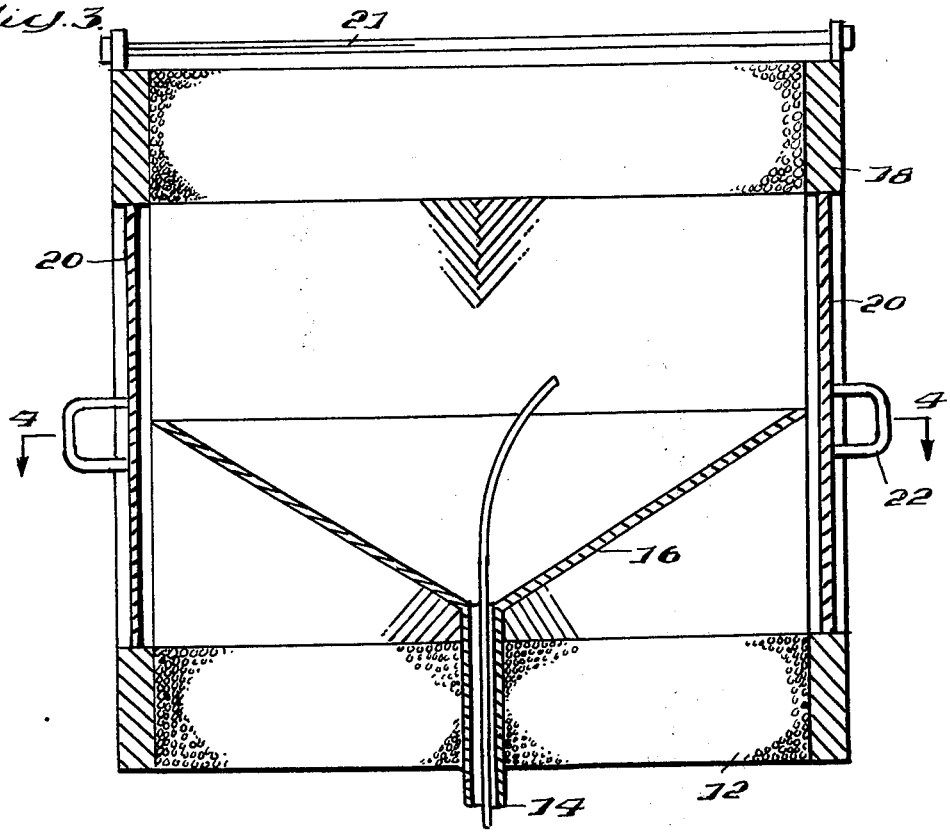
FIG. 3 shows in cross-section a modified form of the invention.
Figure 4:
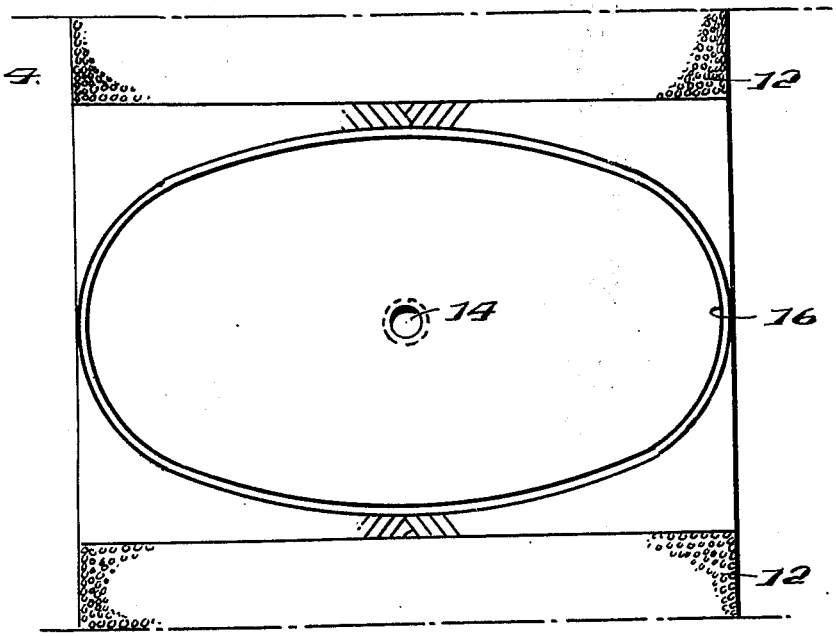
FIG. 4 is a cross-section of the wind substantially on the line 4—4 of FIG. 3.

In the modification of FIGS. 3 and 4, which shows a package with a relatively narrow axial opening, compared to its length, the cone 16 will be oval shaped as shown in FIG. 4. This cone likewise is attached on a tube 14 which passes through a radial opening in the package 12.

The package 12 of FIG. 3 is enclosed between end rings 18, which may be held together by bolts 21 or the like to prevent outward expansion of the walls of the package. Within these rings 18 are end pieces 20, which may be provided with handles 22 and have a tight sliding fit, with some frictional assistance such as rubber, within the rings 18, so that they can be adjusted axially within the rings. It is preferable to adjust these end pieces so that the space between each end piece and the edge of the cone is only slightly more than the cross-section of the flexible material. For this purpose, the end pieces may be made of transparent material such as plastic.

The arrangement shown in FIG. 5 is produced in the manner shown in application of Newman et al., Ser. No. 226,718, filed Feb. 16, 1972, now U.S. Pat. No. 3,803,796. This application shows curved outwardly sloping end forms 22. In the package of FIG. 5, the windings 24 are kept enclosed within the end forms 22, which are then secured together by any suitable arrangement such as bolts 21. A tube 26 passes through the winding 24 and supports the funnel 28. This funnel is slightly wider than the inner radius of the end forms 22. The package is enclosed by end plates 30, which are connected with the inward extensions of the end forms 22 and are secured thereto in the manner shown in FIG. 7, namely by a bent-over portion 32 of the plate 30 which engages an outwardly directed flange 34 of the end form 32. The plates 30 have an outwardly bowed section 36, which accommodates the width of the funnel 28.

It may be desirable to have the funnel able to wobble or rock slightly, in which case the total space between the outer edges of the funnel and the end walls 36 need only be substantially equal to the thickness of the flexible material. For this purpose, the tube 26 has an upward projection 38 which fits within a downward projection 40 of the funnel. A rubber band 42 fitting over the upper end of extension 38 will permit some rocking of the funnel because of the natural looseness of the parts.

Referring to FIG. 8, there is shown an oval funnel 42 of the type shown in FIG. 4, but with the longer sides 44 of the oval downwardly curved, the funnel actually having substantially the shape of a normal funnel of plastic deformable material which has been compressed laterally. The curvature of the longer sides appears to assist in promoting proper movement of the loops.

I claim:

1. A package of flexible material constituted by a plurality of layers each formed of a plurality of figure 8s wound about a common axis with the cross-overs of each layer progressing around the package and having an axial opening therein and a radial opening extending from the periphery of the package to the axial opening, through which radial opening the inner end of the material is led out, a funnel mounted within the axial opening with its axis directed radially of the package and aligned with said radial opening, the mouth of the funnel having a dimension in the axial direction of the package at least substantially as great as the axial dimension of the package.

2. A package as claimed in claim 1, in which the funnel includes a hollow stem extending through the radial opening.

3. A package as claimed in claim 2, including means mounting the funnel on the stem to wobble thereon.

4. In a package as claimed in claim 1 in which the axial dimension of the package is substantially greater than the diameter of the axial opening and the mouth of the funnel is substantially elliptical in shape.

5. In a package as claimed in claim 1, in which the mouth of the funnel extends beyond the ends of the package.

6. A package as claimed in claim 1, including annular members engaging the ends of the package, and means connecting the annular members to each other.

7. In a package as claimed in claim 6, elements mounted within said annular members closing the ends of the axial opening and spaced from the ends of the mouth of the funnel.

* * * * *